US009123198B2

(12) United States Patent
Bond et al.

(10) Patent No.: US 9,123,198 B2
(45) Date of Patent: Sep. 1, 2015

(54) GAMING SYSTEM AND A METHOD OF GAMING

(71) Applicants: Anthony Wayne Bond, Las Vegas, NV (US); Darnell Alfonso Johnson, Henderson, NV (US); Gary Frerking, Henderson, NV (US); John Wootress, Jr., Henderson, NV (US); Scott Monroe Stewart, Las Vegas, NV (US)

(72) Inventors: Anthony Wayne Bond, Las Vegas, NV (US); Darnell Alfonso Johnson, Henderson, NV (US); Gary Frerking, Henderson, NV (US); John Wootress, Jr., Henderson, NV (US); Scott Monroe Stewart, Las Vegas, NV (US)

(73) Assignee: Aristocrat Technologies Australia Pty Limited (AU)

( * ) Notice: Subject to any disclaimer, the term of this patent is extended or adjusted under 35 U.S.C. 154(b) by 149 days.

(21) Appl. No.: 13/691,036

(22) Filed: Nov. 30, 2012

(65) Prior Publication Data

US 2013/0165218 A1 Jun. 27, 2013

Related U.S. Application Data

(63) Continuation of application No. 12/401,289, filed on Mar. 10, 2009, now Pat. No. 8,342,955.

(60) Provisional application No. 61/035,232, filed on Mar. 10, 2008.

(51) Int. Cl.
*A63F 9/24* (2006.01)
*G07F 17/32* (2006.01)

(52) U.S. Cl.
CPC ..... *G07F 17/32* (2013.01); *G07F 17/3202* (2013.01); *G07F 17/3244* (2013.01); *G07F 17/3267* (2013.01)

(58) Field of Classification Search
CPC . G07F 17/32; G07F 17/3244; G07F 17/3267; G07F 17/3202
USPC ..... 463/16–25, 26, 463
See application file for complete search history.

(56) References Cited

U.S. PATENT DOCUMENTS

| | | | | |
|---|---|---|---|---|
| 6,581,936 | B1 * | 6/2003 | Zoccolillo et al. | 273/274 |
| 6,654,029 | B1 * | 11/2003 | Chiu et al. | 715/717 |
| 6,972,128 | B1 * | 12/2005 | Dalgleish et al. | 424/277.1 |
| 2002/0027323 | A1 * | 3/2002 | Vancura et al. | 273/292 |
| 2002/0190471 | A1 * | 12/2002 | Vancura et al. | 273/292 |
| 2003/0036429 | A1 | 2/2003 | Witty | |

(Continued)

FOREIGN PATENT DOCUMENTS

| | | |
|---|---|---|
| AU | 2004200530 | 9/2004 |
| CA | 2544446 | 8/1995 |

(Continued)

*Primary Examiner* — Vongsavanh Sengdara
(74) *Attorney, Agent, or Firm* — McAndrews, Held & Malloy, Ltd.

(57) ABSTRACT

A bonus game controller is disclosed for use with a plurality of gaming machines in networked relationship with the bonus game controller. The bonus game controller comprises a trigger determiner arranged to determine whether a bonus trigger signal has occurred at a gaming device. The bonus game controller is arranged to implement a first bonus game when a bonus trigger signal occurs at a gaming device, and also comprises a bonus prize allocator arranged to allocate a bonus prize to the gaming device based on an outcome of the first bonus game and based on one or more respective outcomes of at least one other subsequent bonus game implemented within a qualification period. A gaming system including a plurality of gaming devices and a game controller is also disclosed. A corresponding method is also disclosed.

19 Claims, 5 Drawing Sheets

(56) References Cited

U.S. PATENT DOCUMENTS

| | | | | |
|---|---|---|---|---|
| 2003/0193139 | A1 | 10/2003 | Vancura | |
| 2004/0009802 | A1 | 1/2004 | Fargano | |
| 2004/0056419 | A1 | 3/2004 | Wirth | |
| 2004/0132524 | A1 | 7/2004 | Ramstad | |
| 2004/0160009 | A1 | 8/2004 | Vancura | |
| 2004/0176162 | A1 | 9/2004 | Rothschild | |
| 2004/0178582 | A1 | 9/2004 | Garrod | |
| 2004/0224746 | A1 | 11/2004 | Fong | |
| 2004/0259620 | A1 | 12/2004 | Roy | |
| 2005/0043102 | A1 | 2/2005 | Anderson | |
| 2005/0161884 | A1 | 7/2005 | Au-Yeung | |
| 2005/0275166 | A1 | 12/2005 | Wirth | |
| 2006/0019743 | A1 | 1/2006 | Roemer | |
| 2006/0046822 | A1 | 3/2006 | Kaminkow | |
| 2006/0046823 | A1 | 3/2006 | Kaminkow | |
| 2006/0087080 | A1 | 4/2006 | Waken | |
| 2007/0015585 | A1* | 1/2007 | Sartini et al. | 463/42 |
| 2007/0060292 | A1 | 3/2007 | Peterson | |
| 2007/0149292 | A1* | 6/2007 | Kaminkow et al. | 463/46 |

FOREIGN PATENT DOCUMENTS

| | | | | |
|---|---|---|---|---|
| CA | 2527553 | | 12/2004 | |
| CA | 2549395 | | 2/2007 | |
| EP | 1380998 | | 1/2004 | |
| EP | 1480175 | | 11/2004 | |
| JP | 2002052130 | | 2/2002 | |
| JP | 2002052132 | | 2/2002 | |
| JP | 2002085699 | | 3/2002 | |
| JP | 2004073825 | | 3/2004 | |
| JP | 2004073826 | | 3/2004 | |
| JP | 2004344511 | | 12/2004 | |
| JP | 2004351052 | | 12/2004 | |
| JP | 2005177137 | | 7/2005 | |
| JP | 2006043484 | | 2/2006 | |
| JP | 2006075212 | | 3/2006 | |
| JP | 2006075559 | | 3/2006 | |
| JP | 2006095136 | | 4/2006 | |
| JP | 2006109983 | | 4/2006 | |
| JP | 2006175272 | | 7/2006 | |
| WO | 0233670 | | 4/2002 | |
| WO | 2005107899 | A1 | 11/2005 | |
| WO | WO 2005107899 | A1 * | 11/2005 | A63F 9/24 |
| WO | 2006028740 | | 3/2006 | |
| WO | 2006/121663 | A2 | 11/2006 | |
| WO | 2007011502 | | 1/2007 | |

* cited by examiner

GAMING SYSTEM AND A METHOD OF GAMING

RELATED APPLICATIONS

This application is a continuation of U.S. patent application Ser. No. 12/401,289 having a filing date of Mar. 10, 2009, which claims priority to U.S. Provisional Patent Application No. 61/035,232 having a filing date of Mar. 10, 2008, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

It is known to provide a gaming system which comprises a plurality of player operable gaming devices connected together in a network and a bonus game controller which communicates with the gaming devices through the network and implements a bonus game when a bonus trigger is received from a gaming device.

Typically, the bonus game controller includes a relatively large screen which is disposed at a location such that players of the gaming devices are able to view the bonus game currently being played by one of the players.

However, with this type of bonus game arrangement, there is little interest in the bonus game by players of the gaming devices not involved in the bonus game.

BRIEF SUMMARY OF THE INVENTION

In accordance with a first aspect of the present invention, there is provided a bonus game controller for use with a plurality of gaming devices in networked relationship with the bonus game controller, the bonus game controller comprising:

a trigger determiner arranged to determine whether a bonus trigger signal has occurred at a gaming device, the bonus game controller being arranged to implement a first bonus game when a bonus trigger signal occurs at a gaming device; and a bonus prize allocator arranged to allocate a bonus prize to the gaming device based on an outcome of the first bonus game and based on one or more respective outcomes of at least one other subsequent bonus game implemented within a qualification period.

In one embodiment, the qualification period is a specific period of time from implementation of the first bonus game. The time period may be fixed or may be pseudo randomly selected.

In an alternative embodiment, the qualification period is a specific number bonus games subsequent to implementation of the first bonus game. The number of bonus games may be fixed or may be pseudo randomly selected.

In an alternative embodiment, the game controller is arranged such that the qualification period commences when a bonus game trigger signal occurs at a gaming device and ends when an end trigger signal occurs at a gaming device.

In one embodiment, the game controller is arranged such that for each gaming device associated with a bonus trigger signal during the qualification period, a first bonus game is implemented and the gaming device is allocated a bonus prize based on an outcome of the first bonus game and based on one or more respective outcomes of at least one other subsequent bonus game implemented after the bonus game up to expiration of the qualification period.

Each gaming device may be arranged to generate a bonus trigger signal when a predefined game outcome occurs, for example when a predefined game outcome occurs such as appearance of a special symbol, or appearance of a predefined combination of symbols during implementation of a base game.

The trigger signal could also be generated by another event apart from a predefined game outcome such as a random trigger delivered by a controller such as described in Olive, U.S. Pat. No. 7,056,215 the disclosure of which is incorporated by reference or randomly or pseudo-randomly determined by a system controller.

In one embodiment, the game controller is arranged such that the qualification period commences when a bonus trigger signal first occurs at a gaming device (or other trigger) after expiration of a previous qualification period.

In one embodiment, the game controller is arranged such that each gaming device associated with a bonus trigger signal has a respective associated qualification period.

In one embodiment, the bonus prize allocated to the first gaming device associated with the trigger signal by the bonus game controller is the sum of the bonus prize, if any, obtained during implementation of the first gaming device and at least a proportion of one or more other bonus prizes, if any, obtained during implementation of at least one other subsequent bonus game implemented within the qualification period.

In one embodiment, the bonus prize allocated to the first gaming device by the bonus game controller is the sum of the bonus prize, if any, obtained during implementation of the first gaming device and all bonus prizes obtained during implementation of at least one other subsequent bonus game implemented within the qualification period.

In one variation, the game controller may be arranged to multiply the bonus amount received by a gaming device if the gaming device is associated with an additional bonus trigger signal during the qualification period. The gaming device may be arranged so that when a gaming device is associated with an additional bonus trigger signal during the qualification period, the player has the option to multiply the received bonus amount or to receive an additional bonus prize, if any, based on implementation of an additional first bonus game and based on at least one other subsequent bonus game implemented within the qualification period.

According to a second aspect of the present invention there is provided a gaming system comprising:

a plurality of gaming devices, each gaming device being arranged to implement a base game; and a bonus game controller according to the first aspect of the present invention.

In one embodiment, the gaming system comprises a display arranged to display bonus games implemented by the bonus game controller. The display may be configured so as to be viewable by all players of gaming devices associated with the gaming system.

The trigger determiner and the bonus prize allocator may be at least partly implemented using a processor.

In accordance with a third aspect of the present invention, there is provided a method of gaming, the method comprising:

implementing a first bonus game when a bonus game trigger signal occurs at a gaming device;

defining a qualification period when a bonus game trigger signal occurs at a gaming device; and allocating a bonus prize to the gaming device based on an outcome of the first bonus game and based on one or more respective outcomes of at least one other subsequent bonus game implemented within a qualification period.

In accordance with a fourth aspect of the present invention, there is provided a computer program arranged when loaded into a computer to instruct the computer to operate in accordance with a bonus game controller, the bonus game controller comprising:

a trigger determiner arranged to determine whether a bonus trigger signal has occurred at a gaming device, the bonus game controller being arranged to implement a first bonus game when a bonus trigger signal occurs at a gaming device; and a bonus prize allocator arranged to allocate a bonus prize to the gaming device based on an outcome of the first bonus game and based on one or more respective outcomes of at least one other subsequent bonus game implemented within a qualification period.

In accordance with a fifth aspect of the present invention, there is provided a computer readable medium having computer readable program code embodied therein, the computer readable program code being arranged when loaded into a computer to cause the computer to operate in accordance with bonus game controller, the bonus game controller comprising:

a trigger determiner arranged to determine whether a bonus trigger signal has occurred at a gaming device, the bonus game controller being arranged to implement a first bonus game when a bonus trigger signal occurs at a gaming device; and a bonus prize allocator arranged to allocate a bonus prize to the gaming device based on an outcome of the first bonus game and based on one or more respective outcomes of at least one other subsequent bonus game implemented within a qualification period.

BRIEF DESCRIPTION OF SEVERAL VIEWS OF THE DRAWINGS

The present invention will now be described, by way of example only, with reference to the accompanying drawings, in which.

DETAILED DESCRIPTION OF THE INVENTION

Figure 1:
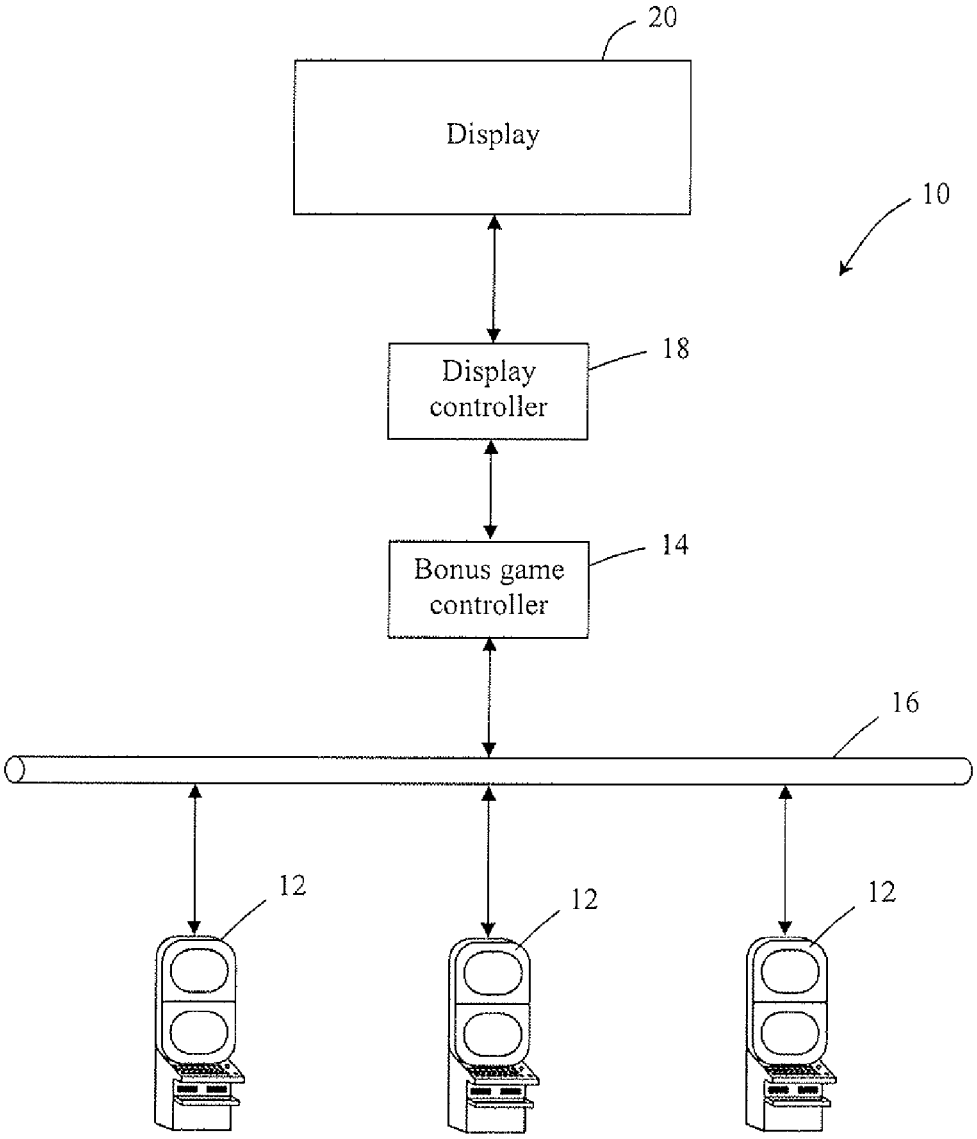
FIG. 1 is a schematic diagram of a gaming system in accordance with an embodiment of the present invention.

Referring to FIG. 1 of the drawings, there is shown a gaming system 10 including multiple player operable gaming devices 12, each of which in this example is a gaming machine arranged to implement a probabilistic wagering base game of the type wherein a player wagers a bet amount, and a game outcome is determined in a probabilistic way. With some such probabilistic games, several symbols from a set of symbols are randomly displayed, and a game outcome is determined on the basis of the displayed symbols.

While the following description is directed to a probabilistic game it should be understood that the present invention could apply to pseudo-probabilistic games such as Class II games as well, e.g. lottery or Bingo based games.

The gaming devices 12 communicate with a bonus game controller 14 through a local network 16, the bonus game controller 14 being arranged to implement a bonus game when a bonus trigger occurs at a gaming device 12.

The gaming system 10 also comprises a display controller 18 and a display 20, the display controller receiving data from the bonus game controller 14 indicative of a bonus game and controlling the display 20 so as to display a representation of the bonus game on the display 20.

In this example, the display 20 is relatively large and is displayed at a location such that players of the gaming devices are able to see the bonus game whilst playing a base game on one of the gaming devices.

Implementation of a bonus game by the bonus game controller 14 commences when a bonus trigger is determined by the bonus game controller 14 to have occurred at a gaming device 12. In this example, a bonus trigger may be generated by a gaming device 12 when a predetermined game outcome occurs, on the basis of a game event occurring during a base game such as display of a particular symbol, a predetermined combination of symbols or in any other suitable way.

The present gaming system operates such that each of the gaming devices 10 implements a base game and during implementation of a base game is able to generate a bonus trigger which causes the bonus game controller 16 to implement a first bonus game. The bonus game controller 14 allocates a prize to a player of a triggering gaming device 12 (the gaming device 12 where the trigger was displayed during the play of the base game) based on a defined first prize, if any, obtained by the player during implementation of the first bonus game plus at least a portion of any prizes obtained by other players during implementation of at least some other bonus games subsequently triggered by other gaming devices 12 or re-triggered by the player obtaining the first trigger condition during a qualification period.

For example, a player of a first gaming device 12 which triggers a first bonus game may receive the sum (or a portion of the sum) of prizes obtained during the first bonus game and prizes obtained during any subsequent bonus games triggered by other gaming devices 12 within a predefined time period after triggering the first bonus game, or may receive the sum of prizes obtained during the first bonus game and obtained during a predefined number of subsequent bonus games triggered by other gaming devices. In this way, players of all gaming devices are able to be involved in the bonus game arrangement, and in particular have an incentive to achieve a bonus trigger early in the bonus cycle so as to increase the likelihood of obtaining a higher bonus prize.

In an alternative arrangement, the bonus game controller 14 implements sets of bonus games based on a predefined time period or based on a predefined number of bonus games. With this arrangement, each trigger causes a sliding bonus game set to commence so that for each player of a triggering gaming device 12 the same number of contributing subsequent bonus games, or the same time period for contributing subsequent bonus games, is provided.

The gaming system 10 can take a number of different forms.

In a first form, a gaming device in the form of a stand alone gaming machine is provided wherein all or most components required for implementing the base game are present in a player operable gaming machine.

In a second form, a distributed architecture is provided wherein some of the components required for implementing the base game are present in a gaming device in the form of a player operable gaming terminal and some of the components required for implementing the base game are located remotely relative to the gaming terminal.

For example, a "thick client" arrangement may be used wherein part of the base game is executed on a gaming terminal and part of the base game is executed by the gaming server, or a "thin client" arrangement may be used wherein most of the base game is executed remotely by the gaming server and a gaming terminal is used only to display audible and/or visible gaming information to the player and receive gaming inputs from the player.

However, it will be understood that other arrangements are envisaged. For example, an architecture may be provided wherein the respective functions of the gaming device and the gaming server are selectively modifiable. For example, the gaming system may operate in stand alone gaming machine mode, "thick client" mode or "thin client" mode depending on the base game being played, operating conditions, and so on. Other variations will be apparent to persons skilled in the art.

Figure 2:
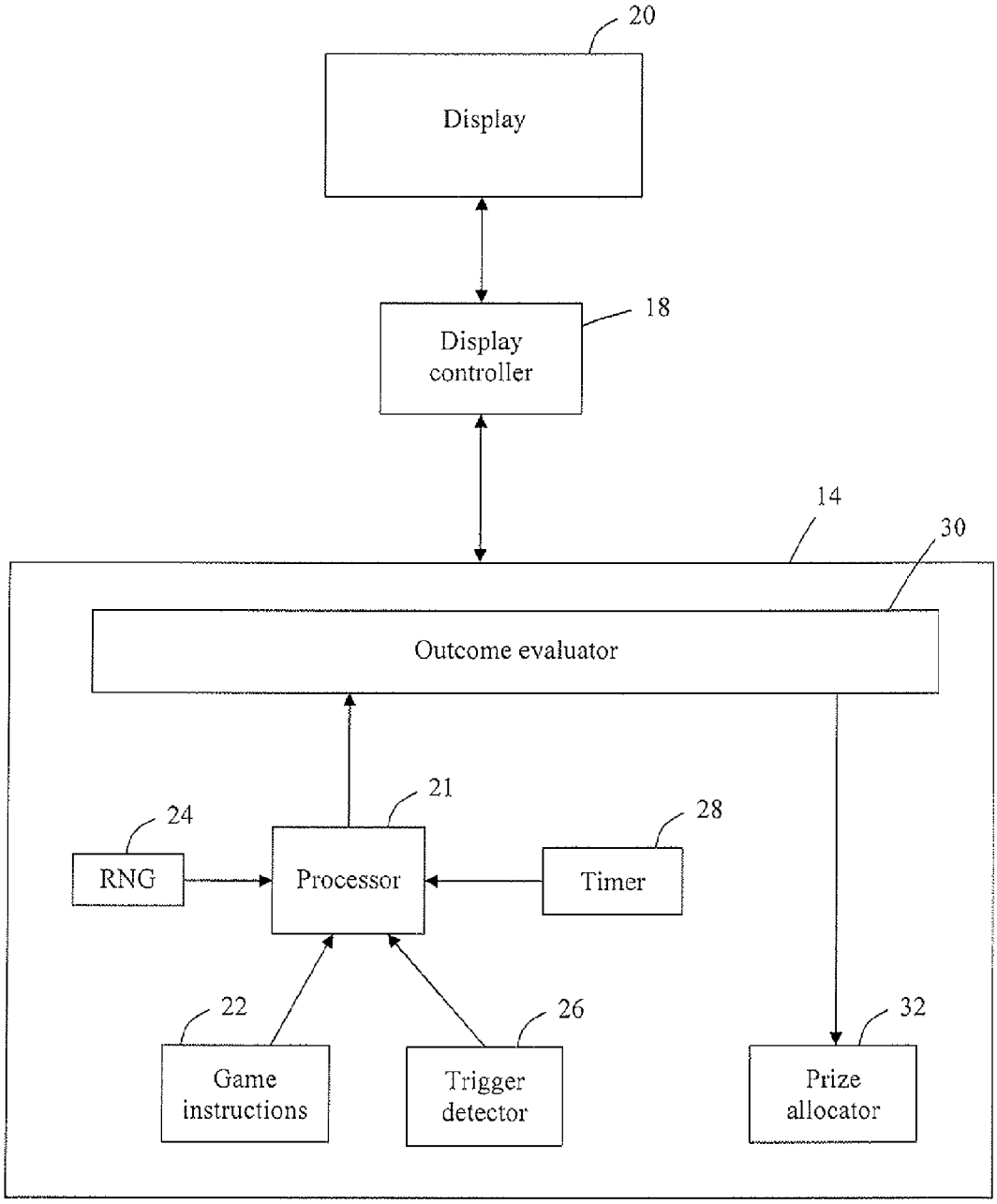
FIG. 2 is a schematic block diagram illustrating operative components of a bonus game controller of the gaming system shown in FIG. 1.

Operative components of the bonus game controller 14 are shown in more detail in FIG. 2.

The bonus game controller 14 includes a processor 21 arranged to process bonus game instructions and output bonus game outcomes to the display controller 18. Typically, the game instructions are stored as program code in a memory that can also be hardwired. It will be understood that in this specification the term "processor" is used to refer generically to any device that can process game play instructions and may include a microprocessor, microcontroller, programmable logic device or other computational device such as a personal computer or a server.

The processor 21 implements a bonus game and operates in association with a random number generator (RNG) 24 to produce probabilistic game outcomes.

It will be appreciated that the random number generator 24 may be of a type which is arranged to generate pseudo random numbers based on a seed number, and that in this specification the term "random" will be understood accordingly to mean truly random or pseudo random.

The processor 21 cooperates with a trigger detector 26 arranged to test for and determine occurrence of bonus triggers at the gaming devices 12 and to notice the bonus triggers to the processor 20. On occurrence of a bonus trigger notification at a first gaming device 12, the processor 21 implements a first bonus game associated with the first gaming device 12 and allocates any resulting prize to the first gaming device 12. Occurrence of the bonus trigger also commences a qualification period during which other gaming devices 12 are able to trigger a bonus game and at least a portion of the prizes awarded during the other bonus games are added to the prize awarded to the first gaming device.

In this example, the qualification period is a predefined period of time determined using a timer 28 which is activated by the processor 20 on receipt of a bonus trigger notification from the trigger detector 26. Alternatively, the qualification period is a predefined number of bonus games which are triggered subsequent to receipt of a bonus trigger notification from the trigger detector 26. The predefined time period or number of bonus games may be fixed or may be variable, for example pseudo randomly selected using the random number generator 24 and the processor 21. As a further alternative, the qualification period may be determined based on occurrence of a commencement trigger signal at a gaming device 12 and occurrence of an end trigger signal at the same or a different gaming device 12.

The bonus game controller 14 also comprises an outcome evaluator 30 which in accordance with the bonus game instructions 22 determines bonus game outcomes based the displayed bonus game results, and a prize allocator 32 arranged to calculate the appropriate prize, if any, to be awarded to a triggering gaming device 12 based on the prize, if any, allocated to an initial triggering gaming device and based on any prizes awarded to other gaming devices 12 which trigger during the qualification period.

It will be understood that the bonus game implemented by the bonus game controller 14 may be of a type wherein a set of symbols are provided and a subset of the symbols are selected and displayed on the display 18, with game outcomes being determined on the basis of the symbols displayed and/or on the basis of the positions of the displayed symbols on the display or the positions of the displayed symbols relative to other displayed symbols. A suitable bonus game is a spinning reel type game, a card type game, a Keno type game, and so on. The bonus game may also include an element of player interaction such as choices of games, selection of elements of a bonus game from an offered set of selections or even a game which has an element of skill such as controlling a race car or horse, selection of pathways from a set of pathways play of a Blackjack or Poker hand and the like.

In the embodiments described below, the trigger detector 26, the timer 28, the outcome evaluator 30, and the prize allocator 32 are at least partly implemented using the processor 21 and associated software, although it will be understood that other implementations are envisaged.

A gaming device 40 of stand alone type, hereinafter referred to as a gaming machine, is illustrated in more detail in FIG. 3. The gaming machine 40 includes a console 42 having a display 44 on which is displayed representations of a base game 46 that can be played by a player. A mid-trim 50 of the gaming machine 40 houses a bank of buttons 52 for enabling a player to interact with the gaming machine during game play, including enabling the player to select the bet amount. The mid-trim 50 also houses a credit input mechanism 54 which in this example includes a coin input chute 54A and a bill collector 54B.

A top box 56 may carry artwork 58, including for example pay tables and details of bonus awards and other information or images relating to the game. Further artwork and/or information may be provided on a front panel 59 of the console 52. A coin tray 60 is mounted beneath the front panel 59 for dispensing cash payouts from the gaming machine 40.

The display 44 is in the form of a video display unit, particularly a cathode ray tube screen device. Alternatively, the display 44 may be a liquid crystal display, plasma screen, any other suitable video display unit. The top box 56 and/or the front panel 59 may also include a display, for example a video display unit, which may be of the same type as the display 44, or of a different type.

A player marketing module (PMM) 62 having a display 64 is connected to the gaming machine 40. The main purpose of the PMM 62 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 62 is a Sentinel III device produced by Aristocrat Technologies Pty Ltd.

The top box 58, front panel 59 and/or the display 44 may further display advertising material which in this example is displayed in response to advertising data downloaded from an advertising server.

Figure 3:
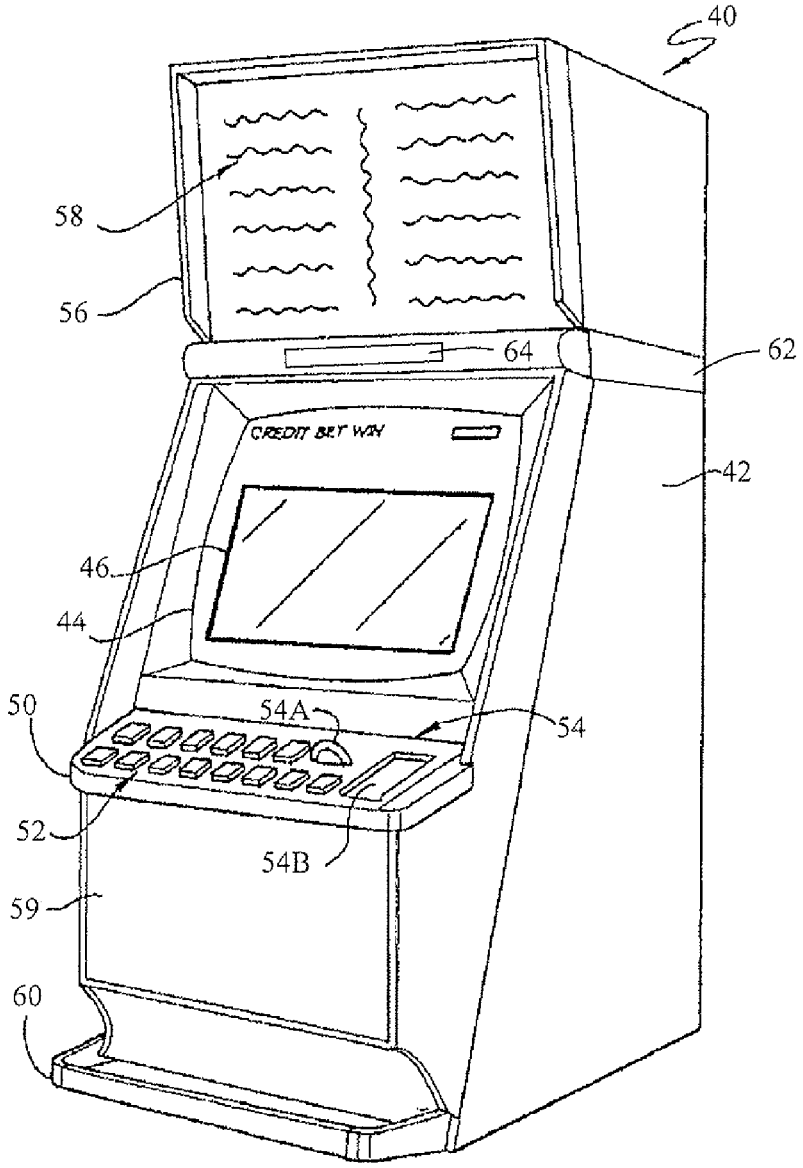
FIG. 3 is a diagrammatic representation of a gaming device of the gaming system shown in FIG. 1.
Figure 4:
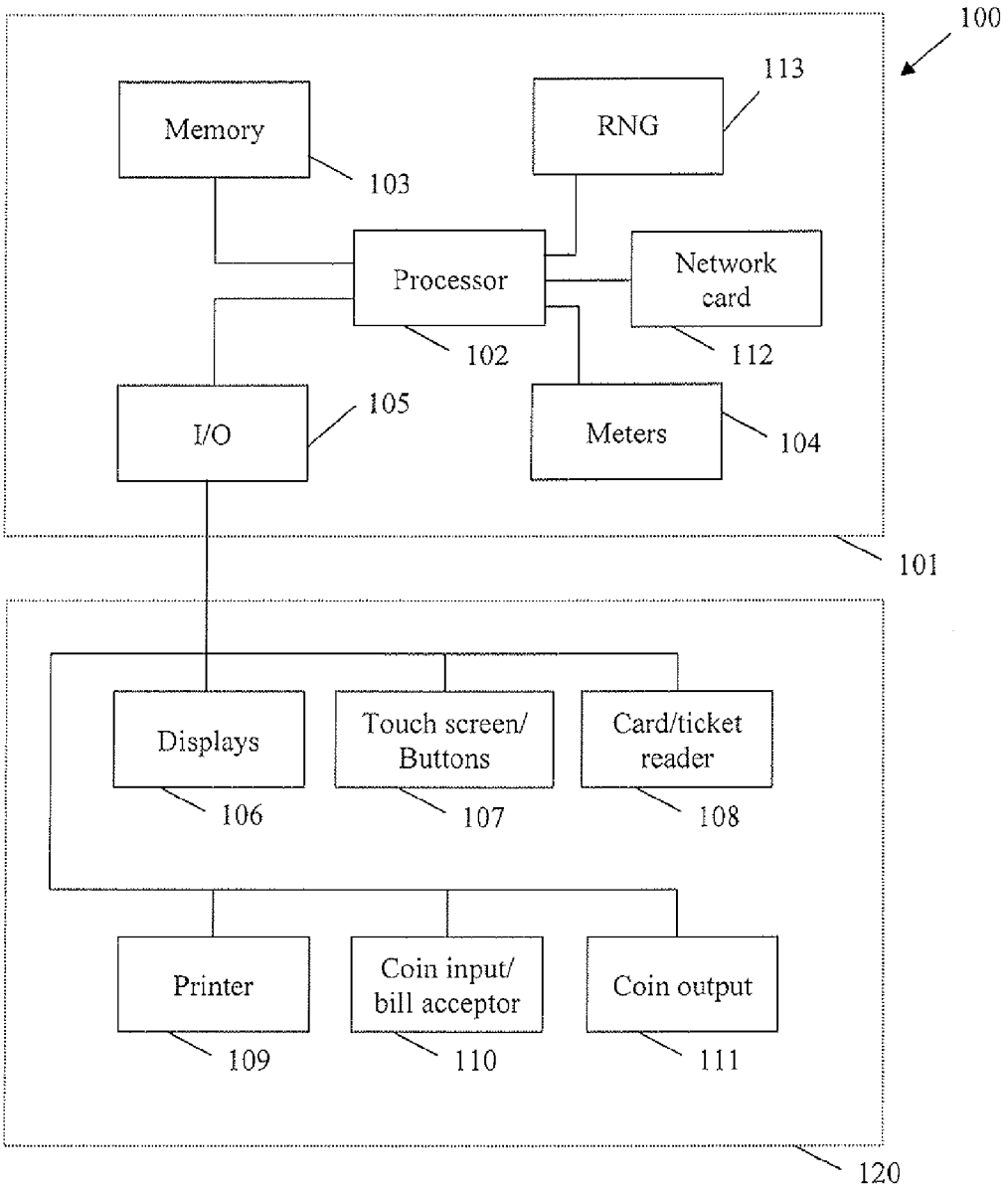
FIG. 4 is a schematic block diagram of operative components of the gaming device shown in FIG. 3.

FIG. 4 shows a block diagram of operative components 100 of a gaming device which may be a gaming machine of the type shown in FIG. 3.

The operative components 100 include a processor 102 and a memory 103. Instructions and data to control operation of the processor 102 are stored in the memory 103. Typically, the gaming machine 100 will include both volatile and non-volatile memory and more than one of each type of memory, with such memories being collectively represented by the memory 103.

Figure 5:
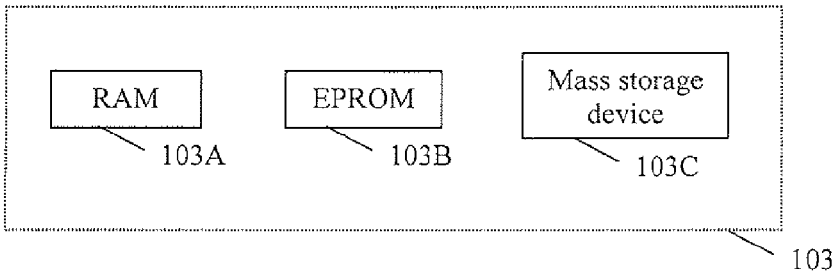
FIG. 5 is a schematic block diagram of components of a memory of the gaming device shown in FIG. 3.

FIG. 5 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine 100 also includes meters 104 for purposes including ensuring regulatory compliance and monitoring player credit, and an input/output (I/O) interface 105 for communicating with a player interface 120.

In the example shown in FIG. 4, the player interface 120 includes at least one display 106, buttons 107 and the credit input mechanism 110, and also comprises a touch screen 107, a card and/or ticket reader 108 and a printer 109. Additional hardware may be included as part of the gaming machine 100, or hardware may be omitted as required for the specific implementation.

In addition, the gaming machine 100 includes a communications interface, for example a network card 112, which facilitates communications between the gaming machine 100 and the bonus game controller 14 through the network 16.

Figure 6:
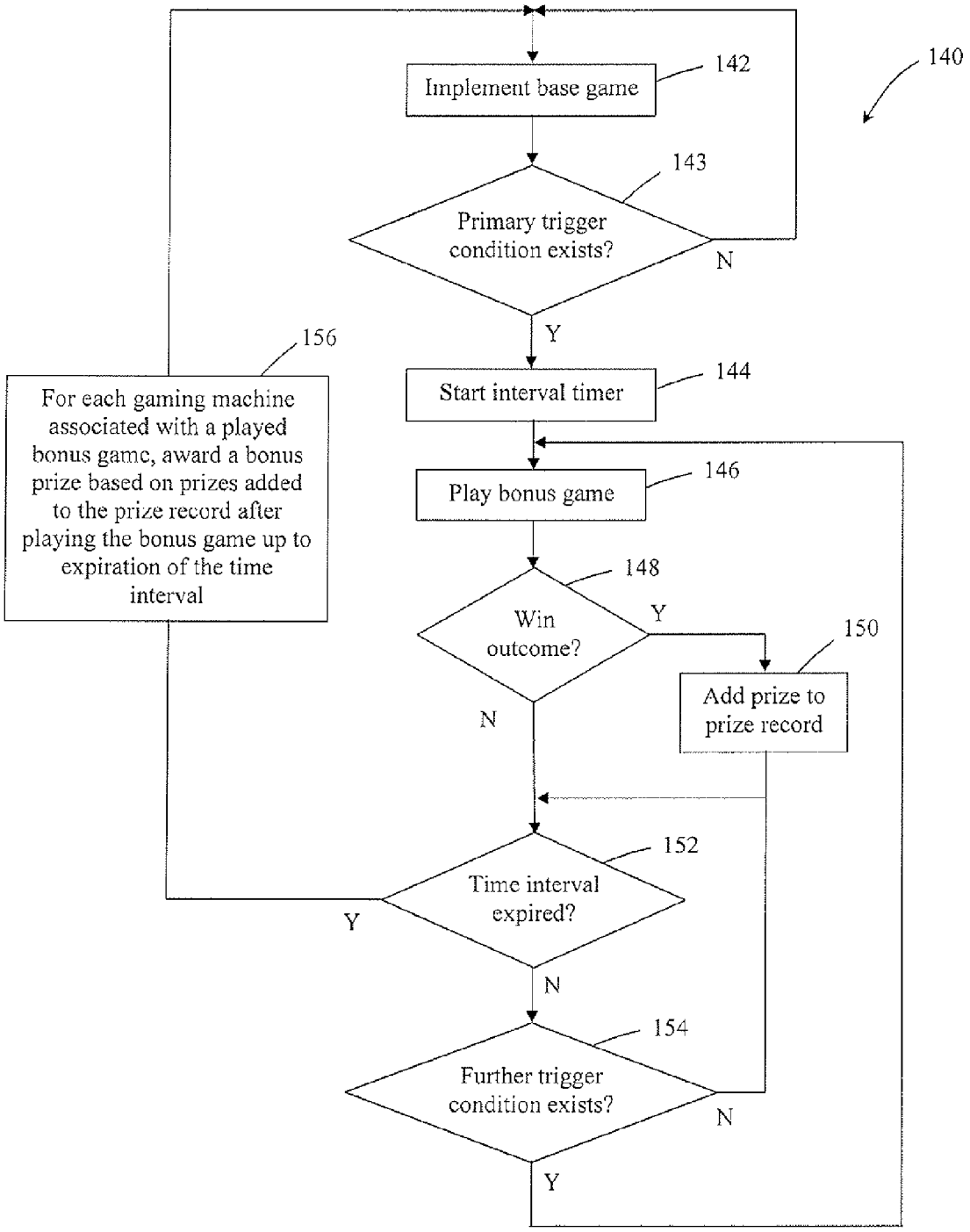
FIG. 6 is a flow diagram illustrating a method of gaming in accordance with an embodiment of the present invention.

Operation of an exemplary gaming system 10 will now be described with reference to the flow diagram 140 shown in FIG. 6. The flow diagram 120 illustrates steps 142 to 156 carried out in a method of gaming in accordance with an embodiment of the invention.

In the present example, three gaming devices 12 are shown associated with the local network 16, although it will be understood that in practice more than three gaming devices 12 would typically be present.

Each gaming device 12 implements 142 a probabilistic base game of the type wherein a player is able to place a bet and obtain a prize when the game results correspond to a winning outcome. In this example, the base game is a spinning reel game of the type wherein several symbols from a set of symbols are randomly displayed, and a game outcome is determined on the basis of the displayed symbols. With such probabilistic games, the set of symbols may include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display in the same line, scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

The base game could also be a Keno game, a video Poker game or other base games where the player makes a wager, and receives a displayed winning or losing outcome. The base game could be a Class II game such as a video lottery or Bingo game as well.

During implementation of a base game, if a trigger condition occurs 143, which may be display of a particular symbol or a particular combination of symbols in the base game, a trigger signal is sent from the gaming device 12 to the bonus game controller 14 through the network 16. On receipt of the trigger signal, the bonus game controller 14 starts 144 the timer 28 and implements 146 a bonus game, in this example a spinning reel type probabilistic game. The bonus game is shown on the display 20 and is viewable by players of other gaming machines 12 associated with the gaming system 10.

After completion of the bonus game, any prize obtained is allocated 150 to the player and stored as a cumulative bonus prize amount. If the qualification period determined by the timer has not yet expired 152 and further bonus triggers have been received from the gaming devices 12, the bonus game controller implements 146 one or more further bonus games associated with the other triggering gaming devices 12 in the order in which the bonus triggers are received after receipt of the initial triggering signal. The bonus game controller then adds 150 any prize(s) obtained by the respective players associated with the further bonus games to the cumulative bonus prize amount. This procedure continues until the qualification period determined by the timer expires.

In one variation, the gaming system may be arranged to multiply the bonus amount received by a gaming device if the gaming device 12 generates an additional bonus trigger signal during the qualification period, e.g. "re-triggers".

After expiration of the qualification period, the player of the initial triggering gaming device 12 (which also started the qualification period) is awarded a prize amount equal to the stored cumulative prize amount. Players of other gaming devices 12 which have triggered after the initial trigger are awarded a bonus prize amount based on the respective bonus prize associated with the player, if any, plus bonus prize amounts associated with subsequently triggering gaming devices 12 up to the end of the qualification period.

As an alternative, instead of determining the qualification period in relation to a time period, the qualification period may be determined in relation to a particular number of bonus games triggered after the initial triggering bonus game.

As a further alternative, the qualification period may be the same for each triggering gaming device 12 such that a sliding sequence of bonus games occurs after each trigger. With this arrangement, a cumulative prize amount may be recorded for each triggering gaming device 12 and the gaming system 10 may be arranged such that each gaming device 12 receives a prize amount equal to the respective stored cumulative prize amount.

It should be understood that while the jackpot controller 14 could be associated with a bank of gaming devices 12 it could also be implemented through software operating at a remote location such as software incorporated into the casino management system such as the OASIS™ system manufactured and sold by Aristocrat Technologies Inc. of Las Vegas, Nev.

While the above example is described in relation to a gaming system having gaming devices which are disposed at the same location, it will be understood that other arrangements are possible. For example one or more of the gaming devices may be located remotely relative to the other gaming devices.

It will also be understood that instead of providing a display which is relatively large and disposed at a location such that players of gaming devices are able to see the bonus game whilst playing a game using a gaming device, as an alternative, the gaming system may be arranged such that bonus games are in addition or alternatively displayed on the gaming devices.

Modifications and variations as would be apparent to a skilled addressee are deemed to be within the scope of the present invention.

The invention claimed is:

1. A bonus game controller for use with a plurality of gaming machines, the bonus game controller comprising:

a trigger detector configured to determine whether a first bonus trigger signal has occurred at one of said gaming machines:

a processor configured to implement a first bonus game when said trigger detector determines the occurrence of said first bonus trigger signal; and a bonus prize allocator arranged to allocate a first bonus prize to said one gaming machine based on an outcome of said first bonus game; and wherein said trigger detector is further configured to determine whether a second further bonus trigger signal has occurred at said one or at another of said gaming machines within a qualification period; and wherein said processor is configured to implement a second further bonus game when said trigger detector determines the occurrence of said second further bonus trigger signal occurring within said qualification period; and wherein said bonus prize allocator is further configured (1) to generate a combined bonus prize formed of said first bonus prize and a further bonus prize based at least in part on a respective outcome of said second further bonus game and (2) to allocate said combined bonus prize to said one gaming machine.

2. A bonus game controller as claimed in claim 1, and wherein the qualification period is a specific period of time from implementation of the first bonus game.

3. A bonus game controller as claimed in claim 2, and wherein the time period is fixed.

4. A bonus game controller as claimed in claim 2, and wherein the time period is pseudo randomly selected.

5. A bonus game controller as claimed in claim 1, and wherein the qualification period is a specific number of bonus games.

6. A bonus game controller as claimed in claim 5, and wherein the number of bonus games is fixed.

7. A bonus game controller as claimed in claim 5, and wherein the number of bonus games is pseudo randomly selected.

8. A bonus game controller as claimed in claim 1, and wherein the qualification period commences when the first bonus trigger signal occurs at said one gaming machine and ends when an end trigger signal occurs at a gaming machine.

9. A bonus game controller as claimed in claim 1, and wherein said combined bonus prize is allocated to said one gaming machine after the expiration of the qualification period.

10. A bonus game controller as claimed in claim 1, and wherein the qualification period commences again when the first bonus trigger signal occurs after expiration of a previous qualification period.

11. A bonus game controller as claimed in claim 1, and wherein a respective qualification period is associated with the first of said plurality of gaming machines which is associated with a first bonus trigger signal.

12. A bonus game controller as claimed in claim 1, and wherein the combined bonus prize allocated to said one gaming machine is the sum of the first bonus prize, if any, obtained during implementation of a first bonus game and at least a proportion of the at least one further bonus prize, if any, within the qualification period.

13. A bonus game controller as claimed in claim 12, and wherein the combined bonus prize allocated to said first gaming machine is the sum of the first bonus prize, if any, obtained during implementation of the first bonus game and all of the at least one further bonus prize.

14. A bonus game controller as claimed in claim 1, and wherein the first bonus prize allocated to said one gaming machine is multiplied if an additional bonus trigger signal occurs at said one gaming machine during the qualification period.

15. A bonus game controller according to claim 1, and further including a gaming system comprising said plurality of gaming machines; and wherein said one gaming machine is configured to implement a base game.

16. A bonus game controller as claimed in claim 15, and wherein said one gaming machine generates said one bonus trigger signal when a predefined game outcome occurs in said base game.

17. A bonus game controller as claimed in claim 16, and wherein the predefined game outcome comprises the appearance of a special symbol during said base game.

18. A bonus game controller as claimed in claim 15, and wherein the gaming system comprises a display, said display configured to display said bonus games.

19. A bonus game controller as claimed in claim 15, wherein the gaming system is arranged to display said first bonus game and said further bonus on at least one of the plurality of gaming machines.

* * * * *